US005338158A

United States Patent [19]

Hauge

[11] Patent Number: 5,338,158

[45] Date of Patent: Aug. 16, 1994

[54] PRESSURE EXCHANGER HAVING AXIALLY INCLINED ROTOR DUCTS

[76] Inventor: Leif J. Hauge, Ovre Bakklandet 5, N-7013 Trondheim, Norway

[21] Appl. No.: 854,678

[22] PCT Filed: Oct. 30, 1990

[86] PCT No.: PCT/NO90/00162

§ 371 Date: Jun. 29, 1992

§ 102(e) Date: Jun. 29, 1992

[87] PCT Pub. No.: WO91/06781

PCT Pub. Date: May 16, 1991

[30] Foreign Application Priority Data

Nov. 3, 1989 [NO] Norway ..... 89 4392

[51] Int. Cl.[5] ..... F04F 11/02

[52] U.S. Cl. ..... 417/64

[58] Field of Search ..... 417/64; 60/39.45 A; 123/559.2

[56] References Cited

U.S. PATENT DOCUMENTS

| | | | |
|---|---|---|---|
| 2,675,173 | 4/1954 | Jendrassik | 417/64 |
| 4,679,393 | 7/1987 | Hellat | 60/39.45 |
| 4,887,942 | 12/1989 | Hauge | 417/64 |

FOREIGN PATENT DOCUMENTS

| | | | |
|---|---|---|---|
| 550937 | 6/1974 | Switzerland . | |
| 1343123 | 10/1987 | U.S.S.R. | 417/64 |
| 1441084 | 11/1988 | U.S.S.R. | 417/64 |
| 1495529 | 7/1989 | U.S.S.R. | 417/64 |
| 8805133 | 7/1988 | World Int. Prop. O. . | |

*Primary Examiner*—Richard A. Bertsch
*Assistant Examiner*—Roland G. McAndrews, Jr.
*Attorney, Agent, or Firm*—Ladas & Parry

[57] ABSTRACT

A pressure exchanger for transfer of pressure energy from one fluid flow to another in a housing having inlet and outlet ducts for each fluid flow and a rotor adapted to rotate about its longitudinal axis within the housing. The rotor is formed with a plurality of rotor ducts arranged around the axis of rotation, the rotor ducts extending from one end of the rotor to the other and having openings at the ends which alternately connect the inlet and outlet ducts of the respective fluids to one another during rotation of the rotor. The rotor is frustoconical in shape and the openings at the larger diameter end of the rotor are spaced from the axis of rotation at a distance which is substantially greater than the radial spacing of the openings at the smaller end of the rotor. The openings at the smaller end of the rotor are located in proximity to the axis of rotation of the rotor and the openings at the larger end of the rotor are disposed in a narrow annular region in proximity to the periphery of the rotor.

8 Claims, 3 Drawing Sheets

PRESSURE EXCHANGER HAVING AXIALLY INCLINED ROTOR DUCTS

FIELD OF THE INVENTION

The invention relates to an arrangement in pressure exchangers for transfer of pressure energy from one fluid flow to another fluid flow, in which the pressure exchanger comprises a housing with an inlet duct and an outlet duct for each fluid flow, a rotor which is designed to rotate about its longitudinal axis inside said housing, and has at least one through duct extending from one end of the rotor to the other end, as seen in an axial direction, and alternately connects the inlet duct and outlet duct for one fluid with the outlet duct, and inlet duct, respectively, of the other fluid, and vice versa, during rotation of said rotor.

BACKGROUND AND PERIOR ART

From NO-PS No. 161 341 and U.S. Pat. No. 4 679 393, among others, a pressure exchanger of the above mentioned kind is known, in which the rotor ducts substantially extend along cylinder faces the longitudinal axis of which coincides with the longitudinal rotor axis, and the rotor is made to rotate by the aid of a motor or by the fact that the velocities of the fluids flowing in and out have different components in the circumferential direction, so that the fluid exerts a turning moment on the rotor. Furthermore, the fluid flow may be achieved by the aid of circulation pumps or by the rotating rotor. It is advantageous that the rotation of the rotor provides the flow, because pumps will render the structure more expensive and complicated, especially in case of low pressures and large volumes of passing flow. The above concept, however, has a limited applicability in this connection, since pressure exchangers functioning in this manner can only provide low feed pressures, while most processes in which pressure recovery may advantageously be used, e.g. processes comprising reverse osmosis, require high feed pressures on the high pressure side. Also, with this manner of operating the rotor, only low initial turning moments can be provided so that rotation of the rotor might easily be prevented by particles brought along by the flow. Pressure exchangers are also known, which operate with high volumes of passing through flows and low pressures, but these are complicated and expensive.

SUMMARY OF THE INVENTION

It is an object of the invention to provide a pressure exchanger, which does not show the above mentioned disadvantages.

The arrangement of the present invention is distinguished by the characterizing features appearing from the claims.

BRIEF DESCRIPTION OF THE DRAWINGS

The invention is now disclosed in more detail with reference to the drawings, which show diagrammatical views of embodiments of an arrangement according to the invention.

DETAILED DESCRIPTION

Figure 1:
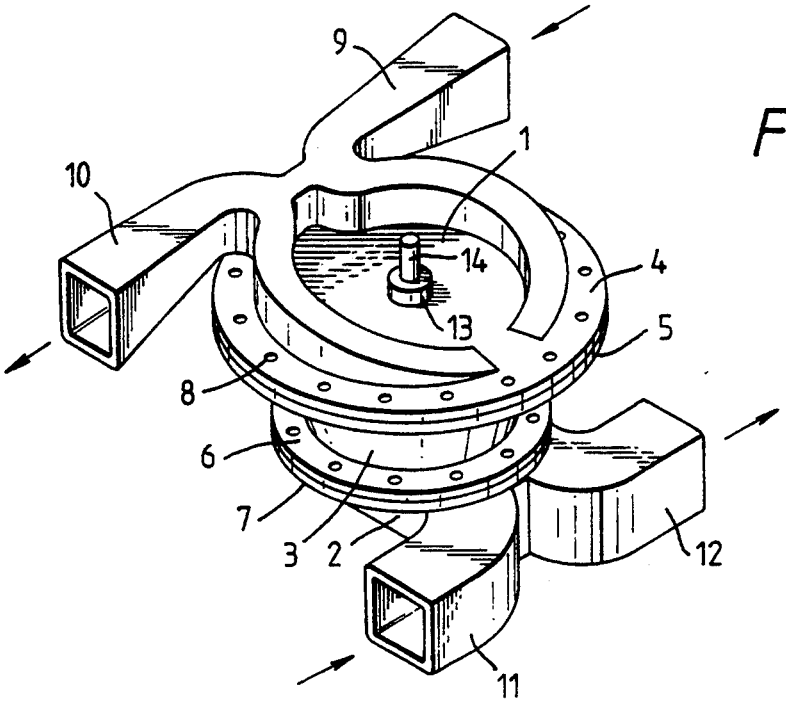
FIG. 1 is a perspective view showing a first embodiment of a pressure exchanger according to the invention.
Figure 2:
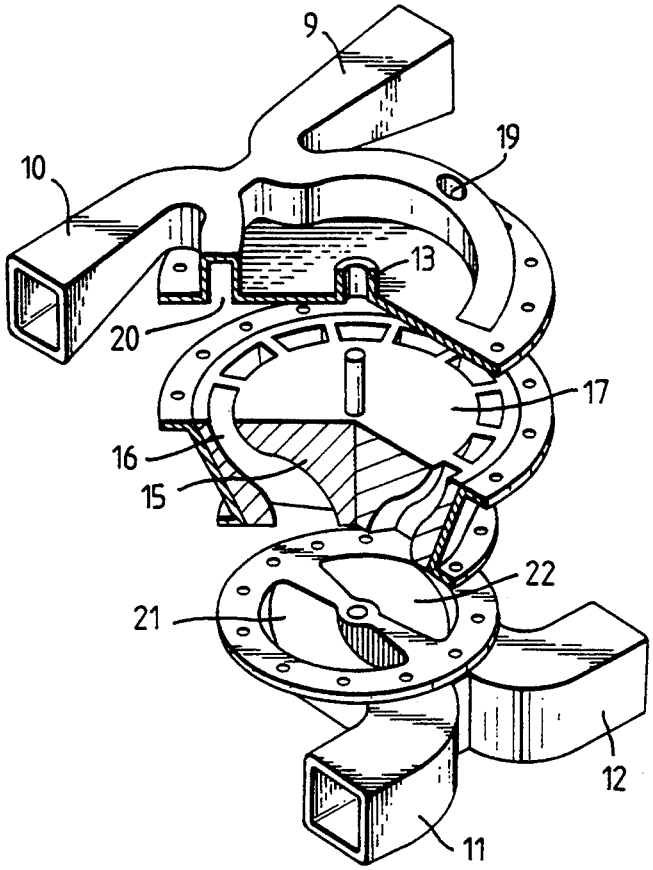
FIG. 2 is a perspective view of the pressure exchanger of FIG. 1, with the components of the exchanger shown in an exploded view and some of them shown in section.

As shown in FIGS. 1 and 2, an embodiment of a pressure exchanger comprises a housing with a top, and a lower end member - or cover 1, and 2, resp., the flanges 4, and 7, resp. of which are connected with flanges 5, and 6, resp. of a housing member 3 extending between the covers, by the aid of screws (not shown) extending through holes 8 in pairs of flanges.

Each end cover 1, 2 has an inlet duct 9, and 11, resp., and an outlet duct 10, and 12, resp., the internal openings of which, i.e. openings 19, 21, 20, and 22, resp., facing the housing member 3, are substantially circular or circle sector shaped and extend across an arc of a circle of approximately 180°. Each end cover has a bearing 13 in which a journal 14 which is formed on each end portion of a rotor 15 is mounted.

The rotor 15 is frustoconical and is rotatably provided in the housing member 3 to be rotatable about its longitudinal axis. From the top end face 17 of the rotor to its lower end face ducts 16 extend, the centre lines of which extend in respective planes comprising the longitudinal rotor axis. The radial distance from the longitudinal axis of each of the rotor duct top openings is larger than the radial distance from the longitudinal axis of each of the lower rotor duct openings. The rotor ducts, thus, extend from the duct top openings downwards and towards the longitudinal rotor axis, and since it is advantageous with regard to the flow that the centre axis of the duct extends substantially normal to the rotor end faces adjacent to the latter, the centre line of the ducts will in the present case be substantially S-shaped. At the top end face 17 of the rotor, the openings of the ducts are disposed in a narrow annular region in proximity to the periphery of the rotor as best seen in FIGS. 2 and 3 whereas the duct openings at the lower end face are disposed in proximity to the axis of rotation.

The end covers 1, 2 of the housing are substantially in sealing contact with the rotor end faces, so that any fluid leak between rotor ducts and between cover ducts, via the slot between respective end covers and rotor, will be minimized.

It will also appear from FIG. 2 that ducts 9, 10, 11, 12 in the end covers, and if desired, rotor ducts 16 may have a gradually changed cross sectional area, as seen in the direction of flow, which will cause a gradually changed static pressure and a changed velocity of the fluid when flowing in the ducts.

Figure 3:
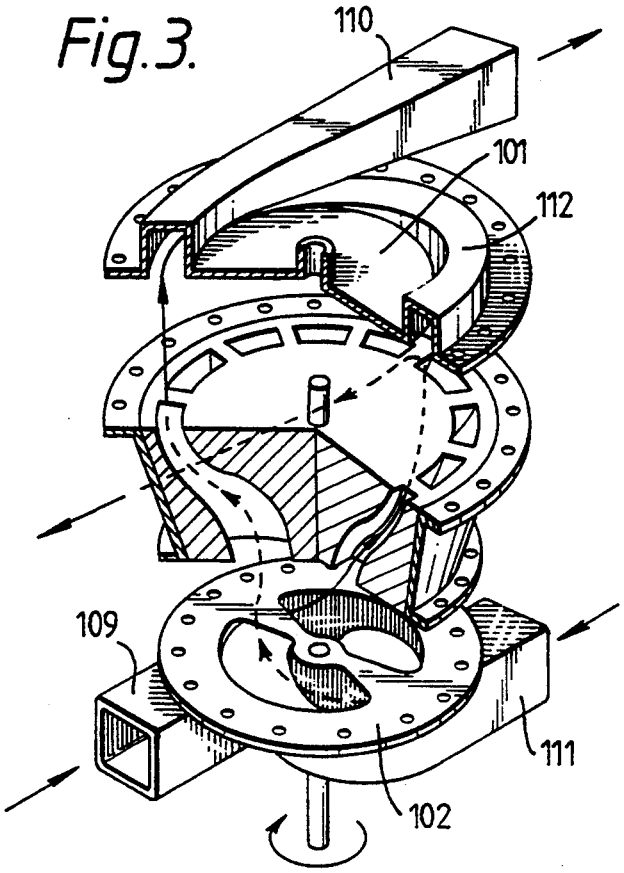
FIG. 3 is a perspective view of a second embodiment of a pressure exchanger according to the invention.

FIG. 3 shows another embodiment of a pressure exchanger according to the invention, in which outlet openings 110, 112 are provided in top cover 101, and inlet openings 109, 111 are formed in lower end cover 102.

Figure 6:
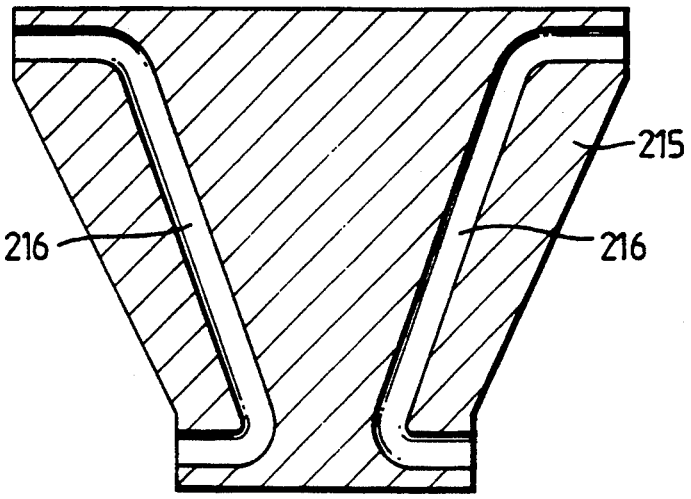
FIG. 6 shows a longitudinal section through a rotor of a third embodiment of a pressure exchanger according to the invention.

FIG. 6 shows a longitudinal section through a variant of rotor 215, the duct inlet and outlet openings of which do not open axially, but radially at the rotor ends. Instead of end covers having inlet and outlet openings, such openings may constitute through slots in the wall of the housing member, with the slots extending across an angular distance of approximately 180°.

The function of the pressure exchanger is disclosed in more detail below with reference to FIG. 4, which shows two diametrically provided rotor ducts 25, 26. A front and a rear wall of a duct should be understood to be its front wall, and rear wall, respectively, in the direction of rotation. The direction of flow through the ducts is indicated by the direction of arrow A, and B, respectively, and the direction of rotation of the rotor is indicated by the direction of arrow C.

To begin with, it should however be assumed that both arrows A, B are directed upwards, so that the fluid will flow axially in the same direction in both ducts 25, 26. This is true of the pressure exchanger which is shown in FIG. 3.

Figure 5:
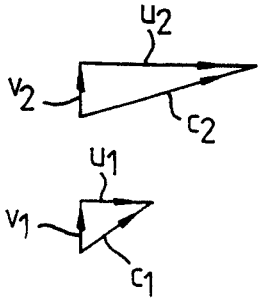
FIG. 5 is a velocity diagram.

If the rotor rotates, and if the fluid has an absolute velocity c 1 at the lower inlet, and if the rotational speed at said duct inlets is u 1, the relative velocity of the fluid will be v 1, as will appear from the velocity diagram in FIG. 5. At the top outlet, where the rotational speed of duct openings is u 2, the absolute outlet velocity of the fluid will be c 2, if we assume that the axial velocity of the fluid during its flow through rotor ducts is constant. In order to maintain a constant rotational speed of the rotor, a turning moment must be supplied to the rotor, e.g. by a motor.

The rotational speed of the rotor and the fluid flow velocity are in this case mutually adapted, so that when, e.g. one inflowing fluid on the left hand side of the Figure has filled the duct on that side, the rotor will have turned so much that the supply is cut, whereupon communication is established between the duct and the inlet and outlet on the right hand side of the Figure, and the fluid in that duct is forced out by the second fluid entering. Fluid of a first kind flowing in through inlet 109 in FIG. 3 will, thus, at first flow into the ducts which communicate with said inlet opening, the fluid of a second kind, which was present there being forced out through outlet opening 112.

When said ducts are filled the rotor will have turned so much that communication with inlet 109 and outlet 112 is cut, whereupon communication with inlet 111 and outlet 110 is established.

Fluid of the second kind now flows into the ducts, via inlet 111 and will force fluid of the first kind out through outlet 110, whereupon communication between said ducts and inlet 109 and outlet 112 is established once more and the process is repeated.

In this case the ducts may extend obliquely, also in the tangential direction, and may thus be optimally adapted to the rotational speed of the rotor, because the passing direction of the fluids through the rotor is the same all the time.

Figure 4:
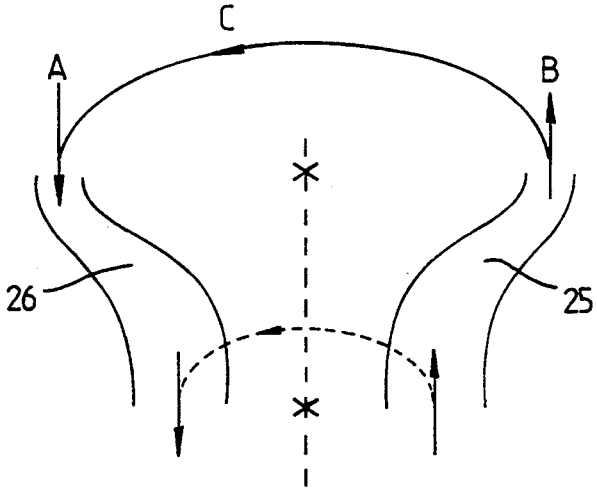
FIG. 4 shows a very simplified longitudinal section through the longitudinal axis of the rotor, and two rotor ducts which are diametrically placed.

If the passing direction of the fluid through the rotor is reversed, i.e. from top and downwards in FIG. 4, it will be necessary to brake the rotor in order to maintain a constant rotational speed of the rotor. Thus, the rotor acts like a pump in the first case, and like a turbine in the second case. If we assume that the passing direction of the fluid through the ducts is as indicated by arrows A and B in FIG. 4, i.e. the fluid flows upwards through ducts 25 and down through ducts 26, the fluid flowing through ducts 26 will tend to drive the rotor faster, whereas the fluid flowing through ducts 25 will tend to slow the rotor down. A device, in which the rotor is supplied with fluid in this manner will, consequently, function like a turbine driven pump, with the ducts in the position as shown at the left hand side in FIG. 4 functioning like a portion of a turbine, whereas the ducts on the opposite side will function like a portion of an impeller.

The level of the static pressure which is exerted to the turbine portion or impeller portion in the inlet and outlet ducts will not be of importance to the turbine and pump effect, respectively, but only constitute a basic operational condition, because the pressure shares caused by fluid velocity and centrifugal force are only added to or subtracted from the current static pressures.

Because the flow passes in both directions through the rotor in this case, the ducts must not have a shape enhancing flow and pressure conditions in one of the directions. They must, consequently, extend in a plane which comprises the longitudinal axis of the rotor, which provides for equal conditions in both flow directions, but which also causes high flowing velocity at the inlet openings, and outlet openings, respectively, the radial distance of which is largest from the rotational axis. Fluid flowing in on the turbine side must, thus, flow through ducts 9 shaped as an inlet nozzle to receive increased velocity in the circumferential direction, and fluid leaving the pp side must flow through duct 10 shaped as an outlet diffusor which will cause a reduction of the velocity and a conversion of velocity energy into pressure energy.

I claim:

1. A pressure exchanger for transferring pressure energy from one fluid to another comprising a housing having opposite ends, an inlet duct at a first of said ends of the housing for a first fluid, an outlet duct at said first end for a second fluid, an outlet duct at the second of said ends of the housing for said first fluid, an inlet duct at said second end for said second fluid, a rotor in said housing supported for rotation about a longitudinal axis of rotation, said rotor having a plurality of rotor ducts arranged around said axis of rotation, said rotor ducts extending from one end of the rotor to the other end of the rotor and having openings at said ends which alternately connect the inlet ducts and the outlet ducts of the first and second fluids respectively, during rotation of the rotor, the inlet and outlet ducts of each fluid respectively being in communication with said openings over an angle of substantially 180°, said openings of said rotor ducts at said first end of the housing being substantially equally spaced radially from said axis of rotation at a distance which is substantially greater than radial spacing of the openings of said rotor ducts at said second end of the housing so that said first fluid flows through said rotor ducts from said first end towards said second end to drive the rotor as a turbine whereas the second fluid flows through said rotor ducts from said second end to said first end and said rotor acts as an impeller, said inlet duct for the first fluid comprising a nozzle, said outlet duct for the second fluid comprising a diffuser.

2. A pressure exchanger as claimed in 1, wherein said openings of said rotor ducts at said first end of the housing are disposed in a narrow annular region in proximity to the periphery of the rotor.

3. A pressure exchanger as claimed in claim 1, wherein said rotor ducts have substantially constant cross-sectional areas along their length.

4. A pressure exchanger as claimed in claim 1, wherein said rotor is positioned vertically and said one end of the rotor is the top of the rotor and said other end of the rotor is the bottom of the rotor.

5. A pressure exchanger as claimed in claim 1, wherein said rotor ducts are shaped to provide constant velocity components axially along the rotor ducts for the fluids flowing through the rotor ducts.

6. A pressure exchanger as claimed in claim 1, wherein said rotor ducts have curved portions between said ends of the rotor.

7. A pressure exchanger as claimed in claim 1, wherein said inlet and outlet ducts for said first and second fluids at said first end of the housing each includes a sector portion extending over an angle of substantially 180° and communicating with openings of said rotor ducts.

8. A pressure exchanger as claimed in claim 7, wherein said sector portions have progressively varying cross-sectional areas.

* * * * *